United States Patent [19]

Garrett

[11] 4,273,201

[45] Jun. 16, 1981

[54] WELL DRILLING COLLARS

[75] Inventor: Wylie Garrett, Hammond, La.

[73] Assignee: Garrett Design, Inc., Hammond, La.

[21] Appl. No.: 135,863

[22] Filed: Mar. 31, 1980

[51] Int. Cl.[3] ..... E21B 17/16

[52] U.S. Cl. ..... 175/107; 175/325; 175/422

[58] Field of Search ..... 175/107, 65, 324, 323, 175/325, 422, 231

[56] References Cited

U.S. PATENT DOCUMENTS

| | | | |
|---|---|---|---|
| 2,634,101 | 4/1953 | Sloan | 175/324 |
| 2,805,043 | 9/1957 | Williams, Jr. | 175/324 |
| 3,908,771 | 9/1975 | Garrett | 175/65 |
| 4,084,636 | 4/1978 | Burge | 175/107 |

*Primary Examiner*—William F. Pate, III

*Attorney, Agent, or Firm*—Burns, Doane, Swecker & Mathis

[57] ABSTRACT

A drill collar for rotary drilling carries a drill bit through which drilling fluid is ejected. The collar includes a cylindrical body having an axial through-bore therein for conducting drilling fluid. A pair of non-radially oriented passages are disposed in the body above the bit, each passage extending partially through the body and including an inner end terminating within the body adjacent the through-bore and an outer end opening into the ambient surroundings. The passages are spaced from the through-bore on opposite sides thereof. Conduits communicate the through-bore with the inner end of each of the passages to discharge drilling fluid through each passage and from the outer ends thereof to establish moments, all of which moments act to augment rotation of the collar. The through-bore is of reduced diameter below the passages to at least partially compensate for the pressure drop caused by the discharge through the passages. The total fluid energy emitted through the passages is in the range of from $\frac{1}{4}$ to $\frac{1}{3}$ of the total fluid energy discharged through the passages and drill bit.

4 Claims, 5 Drawing Figures

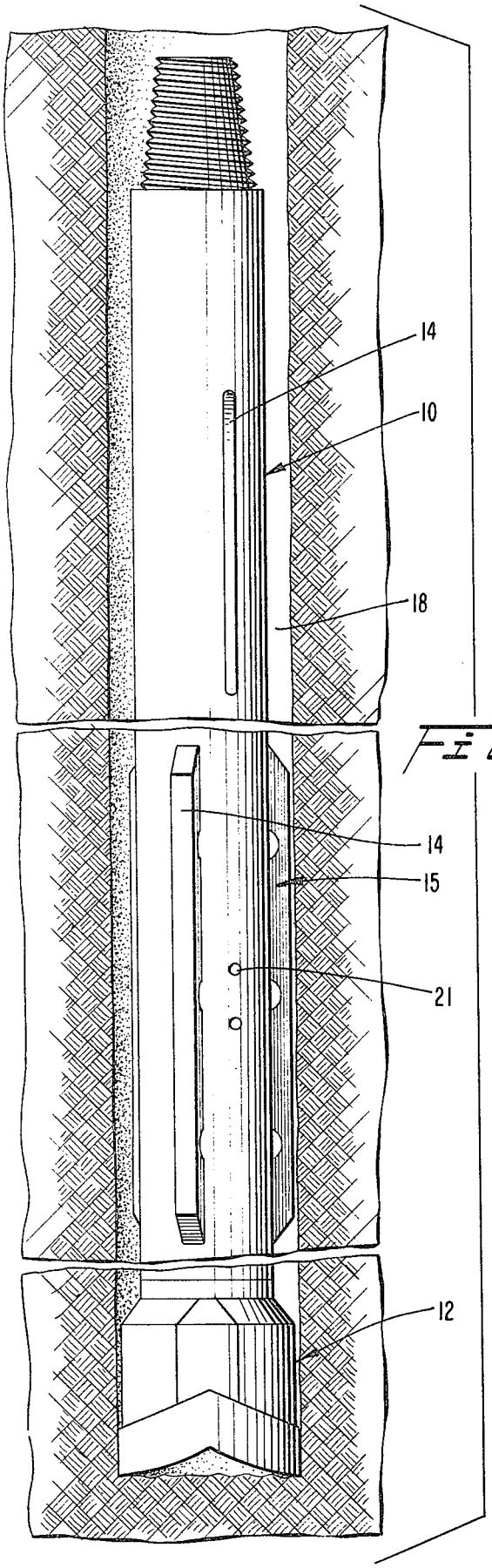
Fig. 1
Fig. 2
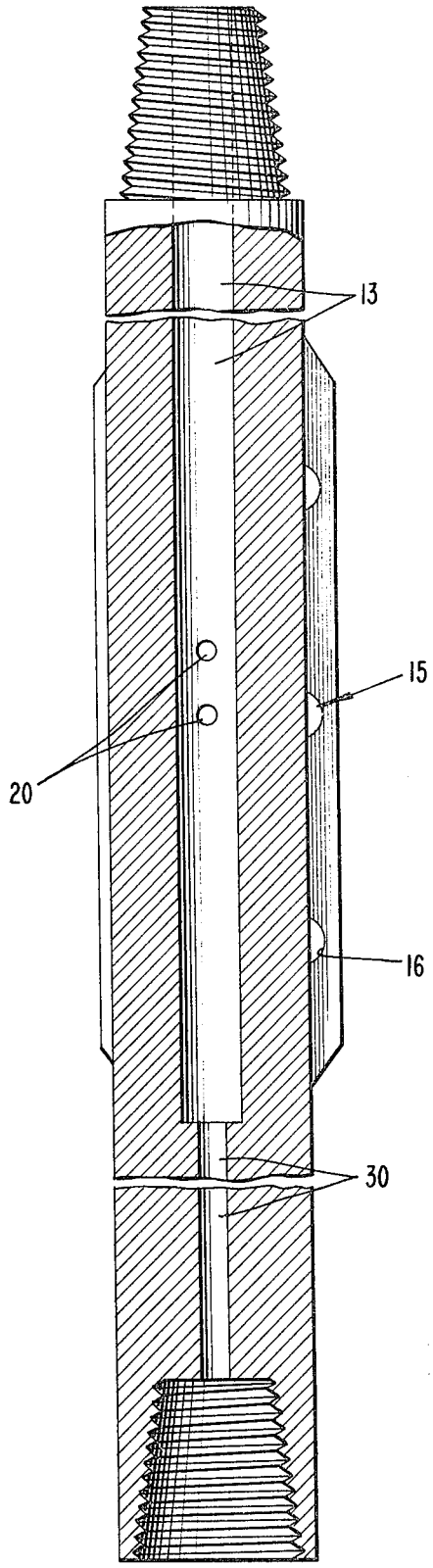

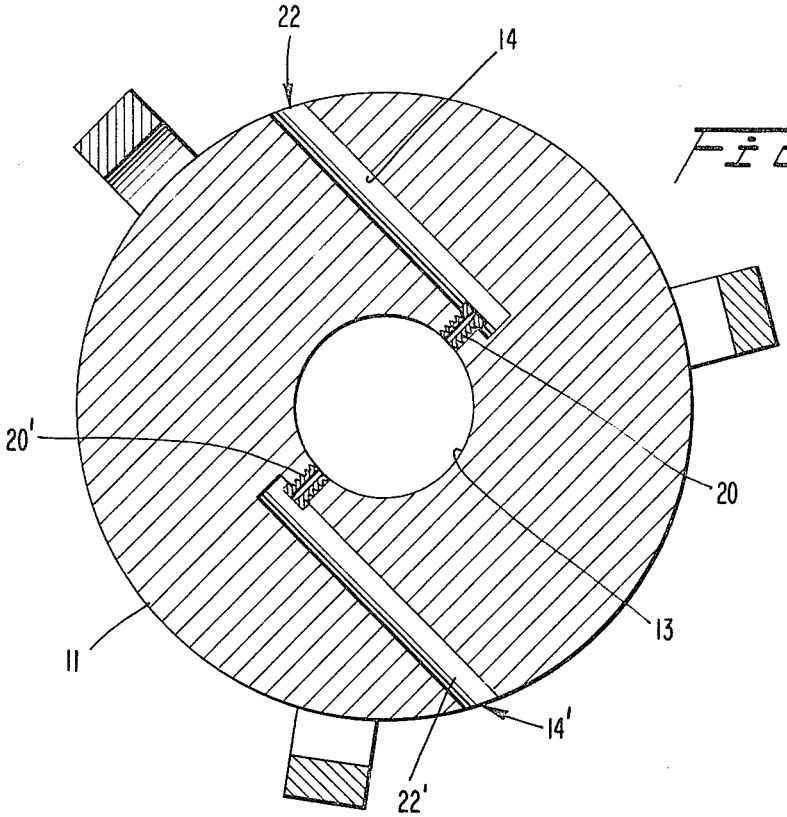
Fig. 3
Fig. 4
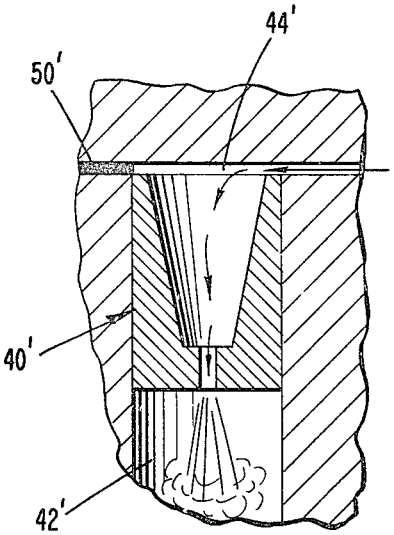
Fig. 5
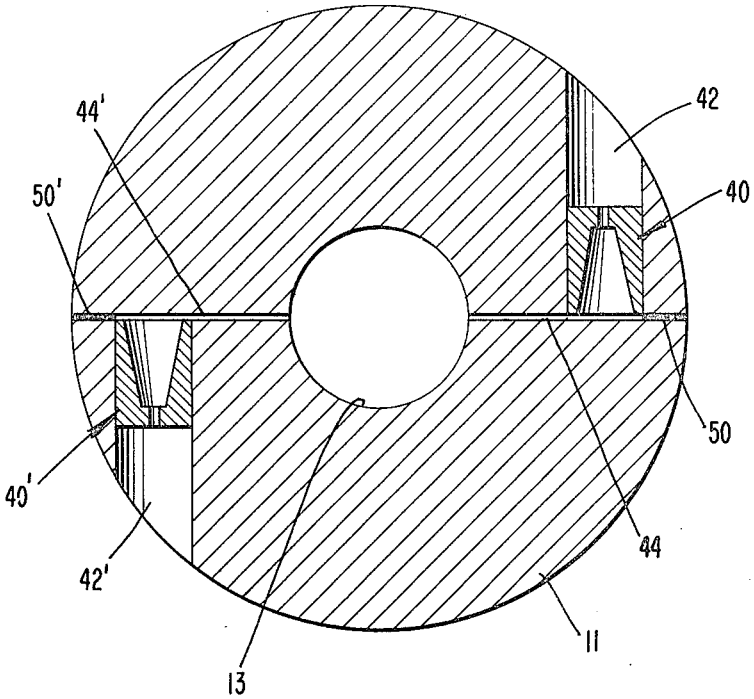

WELL DRILLING COLLARS

BACKGROUND AND OBJECTS OF THE INVENTION

The present invention relates to deep well drilling and, more particularly, to drill collars forming a part of a rotary drill string.

In gas and oil well drilling operations employing the rotary drilling method, it is customary to include one or more drill collars in the drill string above the drill bit. Drill collars are rather heavy rigid members which lend weight and rigidity to the drill string to increase the penetration rate and resist misdirection of the bit axis, thereby tending to maintain a proper vertical direction of travel of the bit.

The collars are tubular to permit downward passage of drilling fluid or mud from the surface, through the string, and through the drill bit into the annulus. The drilling fluid is pumped through the drill collars and drill bit and into the annulus, whereupon it is conducted upwardly to the surface. The drilling fluid serves to seal-off porous zones, flush-out cuttings, and lubricate and cool the drill bit. Problems have heretofore been experienced as the result of excessive drill fluid pressures at the drill bit, which pressures have been relieved by the provision of jets in the drill collars which discharge drilling fluid above the drill bit. As a result, hydrostatic pressure below the jets is reduced and an upward lift is imparted above the bit to the returning fluid. Examples of such jets may be found in U.S. Pat. Nos. 2,765,146 and 2,805,043 issued to Williams, Jr. on Oct. 2, 1956 and Sept. 3, 1957, respectively, and in U.S. Pat. No. 3,908,771 issued to the present inventor on Sept. 30, 1975.

In the disclosed drill collar of U.S. Pat. No. 3,908,771 a plurality of passages are formed completely through the drill collar to define discharge outlets for drilling mud. A nozzle communicates an axial through-bore of the drill collar with the mid-point of the passages, whereupon equal and opposite flows of drilling fluid are discharged from the ends of each passage. While such an arrangement can perform adequately, room for improvement remains.

It is, therefore, an object of the present invention to provide an improved drill collar over that disclosed in U.S. Pat. No. 3,908,771.

It is a further object of the invention to promote fluid uplift in the annulus in a manner assisting rotation of said collar.

It is an additional object of the invention to promote fluid uplift in the annulus in a manner tending to maintain the drill collar vertically oriented.

It is still another object of the invention to discharge drilling mud through the drill collar above the cutter bit in a manner maintaining the discharge passages in an unclogged condition.

BRIEF SUMMARY OF THE INVENTION

These objects are achieved by the present invention which involves a drill collar for rotary drilling and which is of the type carrying a drill bit through which drilling fluid is ejected during drilling operations. The drill collar comprises a cylindrical body having an axial through-bore therein for conducting drilling fluid to the drill bit for ejection therefrom. At least first and second non-radially oriented passages are disposed in the body above the bit. Each passage extends partially through the body and includes an inner end terminating within the body adjacent the through-bore and an outer end opening to the ambient surroundings. The first and second passages are spaced from the through-bore on opposite sides thereof. Conduits communicate the through-bore with the inner end of each of the passages to discharge drilling fluid through each passage and from the outer ends thereof to establish moments. All of the moments act in the direction of rotation of the collar to augment such rotation. The through-bore is of reduced diameter below the passages to at least partially compensate for the pressure drop caused by the discharge through the passages.

Preferably, the total fluid energy emitted through the passages is in the range of from $\frac{1}{4}$ to $\frac{1}{3}$ of the total fluid energy discharged through the passages and drill bit.

THE DRAWING

The objects and advantages of the invention will become apparent from the following detailed description of a preferred embodiment thereof in connection with the accompanying drawings in which like numerals designate like elements, and in which:

FIG. 1 is a side elevational view of a drill collar according to the present invention;

FIG. 2 is a vertical longitudinal sectional view of the drill collar;

FIG. 3 is a cross-sectional view of the drill collar;

FIG. 4 is a cross-sectional view of a modified form of drill collar; and

FIG. 5 is an enlarged view of a nozzle in the embodiment of FIG. 4.

DETAILED DESCRIPTION OF PREFERRED EMBODIMENTS OF THE INVENTION

A drill collar 10 according to the present invention forms part of a drill string which includes a cutter bit 12 at the lower end thereof. The cutter bit 12 is of a conventional nature and includes cutting elements which function to chip away the formation as the drill string is rotated, to form a vertical bore.

The drill collar includes a cylindrical metal body 11 having an axial through-bore 13 therein. Drilling fluid or mud is pumped downwardly from the surface through the axial through-bore 13 and is discharged from jets in the drill bit in conventional fashion, as well as from passages located above the drill bit in accordance with the present invention, as will be described below.

A plurality of stabilizers 15 project radially from the drill collar to vertically stabilize the drill string and assist in cutting or reaming the formation. Apertures 16 extend through the stabilizers to minimize the interference with the circulation of drilling fluid within the well annulus 18.

The passages in the drill collar above the bit through which drilling fluid is ejected may comprise vertically elongate slots 14, 14', which each communicate with the through-bore at vertically spaced locations, or such passages may comprise separate passages 21 in lieu of a common slot.

The slots, 14, 14' are situated laterally of the through-bore, and preferably extend horizontally toward the annulus. Each slot communicates with the through-bore 13 via one or more radial connecting conduits 20, 20'. If a plurality of conduits 20, 20' are provided for a given slot, such conduits are disposed in vertically spaced relationship. Each conduit 20, 20' is defined by a jet nozzle of any suitable type through which drilling fluid is ejected from the through-bore. As noted earlier, the nozzles may be arranged to eject into individual passages, rather than a common passage defined by a slot.

Each slot-type passage 14, 14' terminates at its inner end within the body 11 adjacent the through-bore 13. That is, each slot 14 (or 14') contains only one discharge end 22 (or 22'), as opposed to two discharge ends per slot disclosed in U.S. Pat. No. 3,908,771.

Both slots 14, 14' are disposed non-radially and are spaced from opposite sides of the through-bore 13. The discharge ends 22, 22' of those slots are preferably spaced 180 degrees apart, i.e., they are diametrically opposed.

It will be appreciated that the discharge of fluid from the slot discharge ends 22, 22' creates couples or moments M, M' tending to promote rotation of the drill collar (i.e., to rotate the collar clockwise as depicted in FIG. 3). This action is not present in prior art structures where the fluid is ejected radially, or where the discharge slots are open at both ends so as to produce counter-balancing moments. In the latter case, where the slots are open at both ends, the fluid supplied to a given passage is divided, and thus the velocity or energy of fluid discharged from the slot is less than in the present invention where all the fluid from a passage is confined to be discharged through only one end of a slot. The present invention may thus provide fewer discharge points around the collar periphery, but the energy of the discharged fluid at those points is greater. Thus, there are produced forces of greater intensity reacting against the formation which are better able to prevent the drill string from deviating from vertical. Also, the higher velocity discharges are better able to resist clogging of the slots and achieve a cleaning of the hole being drilled. Furthermore, as noted earlier, the moments produced by the discharging fluid aid in turning of the collar.

It has been found that those advantages are maximized if the total pressure or energy dissipated through all passages above the cutter bit lies in the range of from $\frac{1}{4}$ to $\frac{1}{3}$ of the total discharge pressure or energy dissipated through the collar (i.e., the total discharge from the passages plus drill bit).

Importantly, the energy dissipated from the passages must be equalized 180 degrees apart in order to stablize the drill string.

In order to compensate within the drill collar for the appreciable pressure drop caused by fluid discharged above the drill bit, the bore 13 includes a stepped-down or reduced diameter 30 located below the lowermost passage to maintain a high velocity of the fluid conducted to the drill bit.

In FIGS. 4 and 5 an alternate arrangement is disclosed wherein nozzles 40, 40' are aligned with individual passages (or, alternately, slots) 42, 42'. This arrangement is created by drilling the passages 42, 42', as well as smaller holes 44, 44' which intersect the passages and the bore 13. The nozzles 40, 40' are installed within the passages in any suitable fashion and the outer ends of the holes 44, 44' are suitably plugged at 50, 50' as by a weld or by carbide inserts for example. If desired, a flow tube can be installed within the hole between the through-bore and the nozzle.

It will thus be appreciated that the present invention provides, in conjunction with a drill collar, a highly advantageous manner of promoting fluid uplift in the well annulus. The fluid-ejecting passages in the drill collar are sized for a relatively high pressure, i.e., in the range of from $\frac{1}{4}$ to $\frac{1}{3}$ of the total pressure in the passages and cutter bit. The fluid ejected from the drill collar above the cutter bit is directed to augment the turning forces imposed on the collar. Inner ends of the fluid discharge passages terminate within the drill collar so that fluid discharge intensity is increased relative to arrangements wherein the passages extend completely through the drill collar, thereby tending to maintain the drill string in vertical orientation, and prevent clogging of the passages.

Although the invention has been described in connection with preferred embodiments thereof, it will be appreciated by those skilled in the art that additions, substitutions, modifications, and deletions not specifically described may be made without departing from the spirit or scope of the invention as defined in the appended claims.

What is claimed is:

1. In a drill collar for rotary drilling and which is of the type carrying a drill bit through which drilling fluid is ejected during drilling operations, said drill collar comprising:

a cylindrical body having an axial through-bore therein for conducting drilling fluid to said drill bit for ejection therefrom, at least first and second non-radially oriented, horizontally extending passages in said body above said bit, each passage extending partially through said body and including an inner end terminating within said body adjacent said through-bore and an outer end opening into the ambient surroundings, said first and second passages being spaced from said through-bore on opposite sides thereof, conduit means communicating said through-bore with the inner end of each of said passages to discharge drilling fluid through each passage and horizontally from the outer ends thereof to establish horizontal moments, all of which horizontal moments act in the direction of rotation of said collar to augment such rotation, said through-bore being of reduced diameter from a location below said passages to said bit to at least partially compensate at said bit for the pressure drop caused by the discharge through said passages.

2. Apparatus according to claim 1, wherein fluid nozzles are disposed in said conduit means.

3. Apparatus according to claim 1, wherein said first and second passage each comprise a vertically elongate slot, said conduit means comprising a plurality of vertically spaced conduits communicating said through-bore with a first slot and a plurality of vertically spaced conduits communicating said through-bore with a second slot.

4. Apparatus according to claim 1, wherein said outlet ends of said first and second passages are spaced 180 degrees apart.

* * * * *